US007182909B2

(12) United States Patent
Rabinovich

(10) Patent No.: US 7,182,909 B2
(45) Date of Patent: Feb. 27, 2007

(54) FORGING QUENCH

(75) Inventor: Albert Rabinovich, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 347 days.

(21) Appl. No.: 10/621,298

(22) Filed: Jul. 17, 2003

(65) Prior Publication Data

US 2005/0012250 A1 Jan. 20, 2005

(51) Int. Cl.
*C21D 1/667* (2006.01)
*F27D 15/02* (2006.01)

(52) U.S. Cl. ..... 266/259; 266/274; 148/647

(58) Field of Classification Search ..... 266/259, 266/46, 274; 148/647
See application file for complete search history.

(56) References Cited

U.S. PATENT DOCUMENTS 4,098,495 A 7/1978 Lhenry et al.
4,407,487 A * 10/1983 Wang ..... 266/259
4,504,042 A 3/1985 Kruppert
6,224,693 B1 5/2001 Garza-Ondarza et al.
6,394,793 B1 5/2002 Bunge
6,507,999 B1 * 1/2003 Kaibyshev et al. .... 29/888.044
2001/0020503 A1 9/2001 Stratton
2003/0098106 A1 5/2003 Rabinovich et al.
2005/0127583 A1 * 6/2005 Berglund et al. ..... 266/259

FOREIGN PATENT DOCUMENTS

GB 1 447 335 8/1976

OTHER PUBLICATIONS

European Search Report for EP Application No. 04254227, no date.

* cited by examiner

*Primary Examiner*—Scott Kastler
(74) *Attorney, Agent, or Firm*—Bachman & LaPointe, P.C.

(57) ABSTRACT

Apparatus and methods are provided for cooling workpieces. A cooling gas is directed toward a surface of a workpiece. The cooling gas includes at least a first component that is gaseous at a reference ambient condition and a second component that is a liquid at the ambient condition. The second component may be delivered as a gas or as droplets.

24 Claims, 8 Drawing Sheets

FORGING QUENCH

CROSS-REFERENCE TO RELATED APPLICATION

Related subject matter is disclosed in U.S. patent application Ser. No. 09/683,185, filed Nov. 29, 2001, herein incorporated by reference, and published May 29, 2003 as publication 2003/0098106A1. Benefit of the filing date of the '185 application is not claimed.

BACKGROUND OF THE INVENTION (1) Field of the Invention

The invention relates to a cooling of metal articles. More particularly, the invention relates to the quenching of superalloy forgings.

(2) Description of the Related Art

Controlled cooling of heat treated metal articles is critical to achieve desired material properties. Historically, quench cooling has been achieved by immersion in liquid (e.g., water or oil). More recently, the gas turbine engine industry has seen proposals for gas impingement cooling of superalloy components. For example, U.S. patent application publication No. 2003/0098106 and U.S. Pat. No. 6,394,793 disclose air impingement cooling apparatus. The disclosures of the '106 publication and the '793 patent are incorporated herein by reference as if set forth at length.

There remains further room for improvement in cooling apparatus and methods.

SUMMARY OF THE INVENTION

Accordingly, one aspect of the invention involves an apparatus for cooling a metallic workpiece. A support surface supports the workpiece in an operative position. There is a source of a cooling gas and additional coolant. The cooling gas has one or more constituent gases that are gases at reference ambient conditions (e.g., 21° C. and standard atmospheric pressure). The additional coolant comprises one or more constituents that are liquid at the reference ambient conditions. A conduit system directs the cooling gas and the additional coolant from the source and has a number of outlets positioned to discharge a mixture of the cooling gas and the additional coolant to impinge the workpiece in the operative position.

In various implementations, the additional coolant one or more constituents may include water. Such water may have a flow rate of 5–20% of a mass flow rate of the cooling gas. A major portion of such water may be steam. A major portion of such water may alternatively be in droplet form. The support surface may be provided by surface portions of a number of vertically-extending rods. The apparatus may include a motor and a linkage coupling the motor to the support surface and driven by the motor to oscillate the workpiece. The source may include a first source of the cooling gas and a second source of the additional coolant.

Another aspect of the invention involves an apparatus for cooling a metallic workpiece. The workpiece has a cross-section including a first portion and substantially thicker and more massive and a second portion that is relatively thinner and less massive. The apparatus includes a fixture for supporting the workpiece. The apparatus includes a source of a mixture of compressed cooling gas containing liquid droplets for quenching the workpiece. The apparatus includes a set of tubes for delivering a directing the compressed cooling gas onto the workpiece. The tubes have a multiplicity of outlets aimed at the workpiece so that the compressed cooling gas flows onto the first portion that is substantially thicker and more massive and away from the second portion that is relatively thinner and less massive.

In various implementations, the source may include a first gas source of the compressed cooling gas and means for adding the liquid droplets to the cooling gas along a gas flowpath between the first gas source and the workpiece. The apparatus may further include means for providing relative movement of the forging and tubes during the cooling. The apparatus may impingement cool the workpiece.

Another aspect of the invention involves a method for cooling a forging. At least a first fluid that is a gas in ambient conditions is mixed with at least a second fluid that is a liquid at ambient conditions to form a mixture. A mass flow of the at least a second fluid is 2–20 percent of a mass flow of the at least a first fluid. The mixture is directed to impinge on a surface of the forging so as to cool the forging.

In various implementations, the mixing may form the mixture with the second fluid in major part as a gas or, alternatively, in major part as a liquid. The mixing may form the mixture comprising air essentially as the first fluid and water essentially as the second fluid. The mixing may form the mixture consisting essentially of air as the first fluid and water as the second fluid. The directing may involve directing a first portion of the mixture to impinge upon first portions of the surface and directing a second portion of the mixture to impinge upon second portions of the surface, substantially opposite the first portions. The method may be performed on a turbine engine disk as the forging. The method may be performed on a nickel-space or cobalt-based superalloy article as the forging. The method may further include oscillating the forging. The oscillation may include reciprocal rotation about an axis at an amplitude of at least ±4° and a frequency of less than 2.0 Hz.

Another aspect of the invention involves a method for heat treating a forging. At least a first fluid that is a gas at ambient conditions is mixed with at least a second fluid that is a liquid at ambient conditions to form a mixture. A mass content of the second fluid is 2–20 wt. % of a mass content of the first fluid. The mixture is directed to impinge on a surface of the forging so as to cool the forging. The forging is oscillated. The forging may be a nickel- or cobalt-based superalloy forging.

Another aspect of the invention involves an apparatus for cooling a heat treated metallic workpiece. The apparatus includes a fixture for supporting the workpiece. The apparatus includes a source of a cooling gas for quenching the workpiece. The apparatus includes a conduit system delivering the cooling gas from the source and directing the cooling gas onto the workpiece so as to cool the workpiece. The apparatus includes means for moving the workpiece relative to the conduit system during the cooling of the workpiece.

In various implementations, the means may produce oscillation of the workpiece and may include an electric motor. A mechanical linkage may couple the motor to the fixture so that continuous rotation of a shaft of the motor in a first direction produces oscillation of the fixture.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
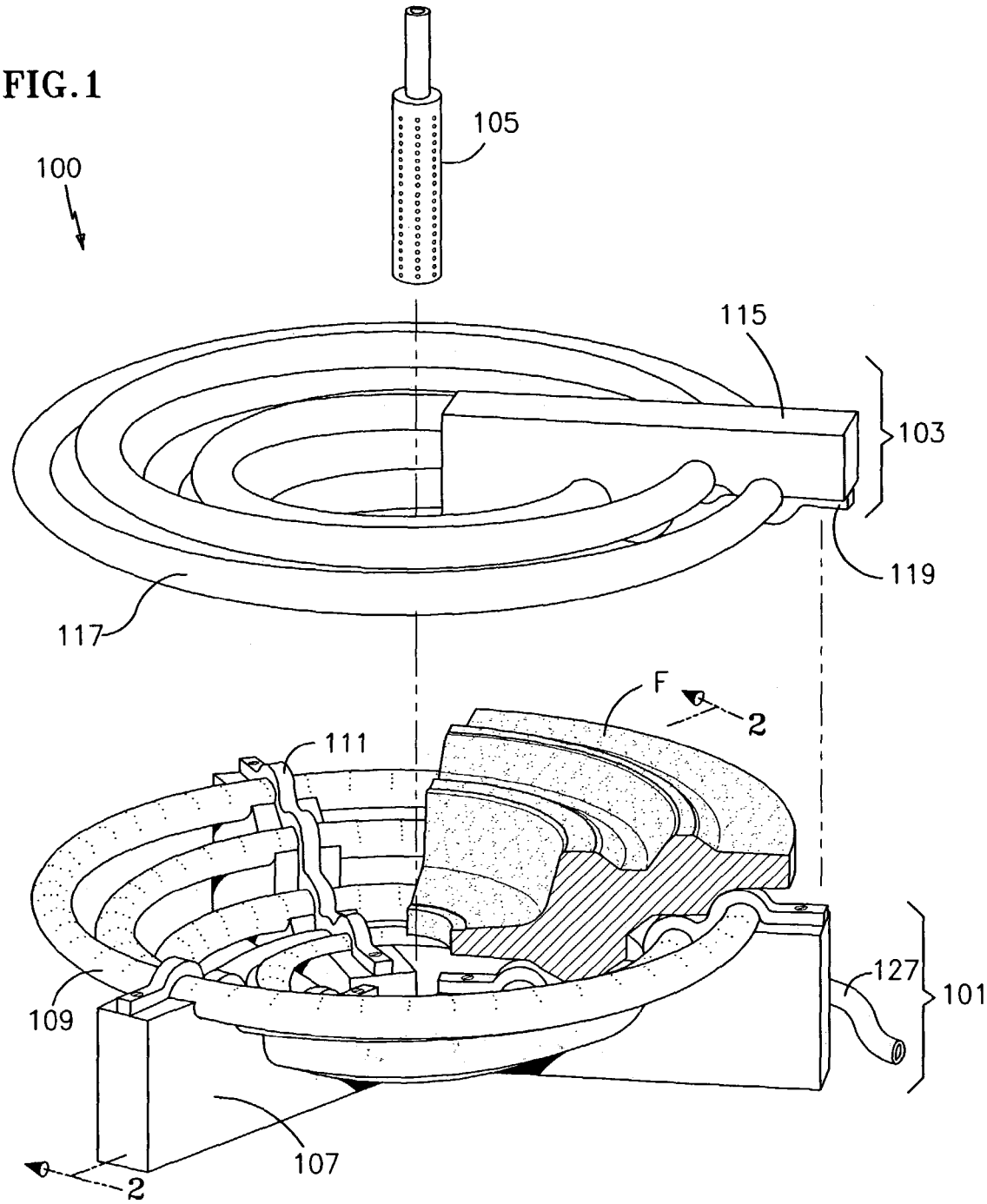
FIG. 1 is an exploded, perspective view of one embodiment of the quenching apparatus of the present invention.

FIG. 1 displays an exploded perspective view of one embodiment of a quenching apparatus 100. The quenching apparatus 100 can receive an annular forging F (only partially shown in the figure), such as a turbine disk or an air seal. Although accommodating an annular shape, the apparatus could heat treat any shape of forging F.

Similarly, the apparatus 100 could quench a forging made from any material. The preferred material, however, is a high temperature aerospace alloy. Generally speaking, such material must have adequate performance characteristics, such as tensile strength, creep resistance, oxidation resistance, and corrosion resistance, at high temperatures. Course grained nickel alloys are especially prone to quench cracking due to a ductility trough at the upper temperatures (e.g. 1800–2100° F.) of the quenching process. Examples of high temperature aerospace materials include nickel alloys such as IN100, IN1100, IN718, Waspaloy and IN625.

To achieve these characteristics, the aforementioned alloys demand precise control of the quenching process. Precise control is necessary to avoid cracking of the forging during quenching and to avoid residual stress effects during subsequent manufacturing operations on the forging. Typically, most forgings that exhibit cracks during quenching are considered scrap.

The quenching apparatus 100 preferably can provide impingement cooling to all surfaces of the forging F. The apparatus 100 includes a first cooling section 101, a second cooling section 103 and a central cooling section 105. Each section will now be described in further detail.

Figure 3:
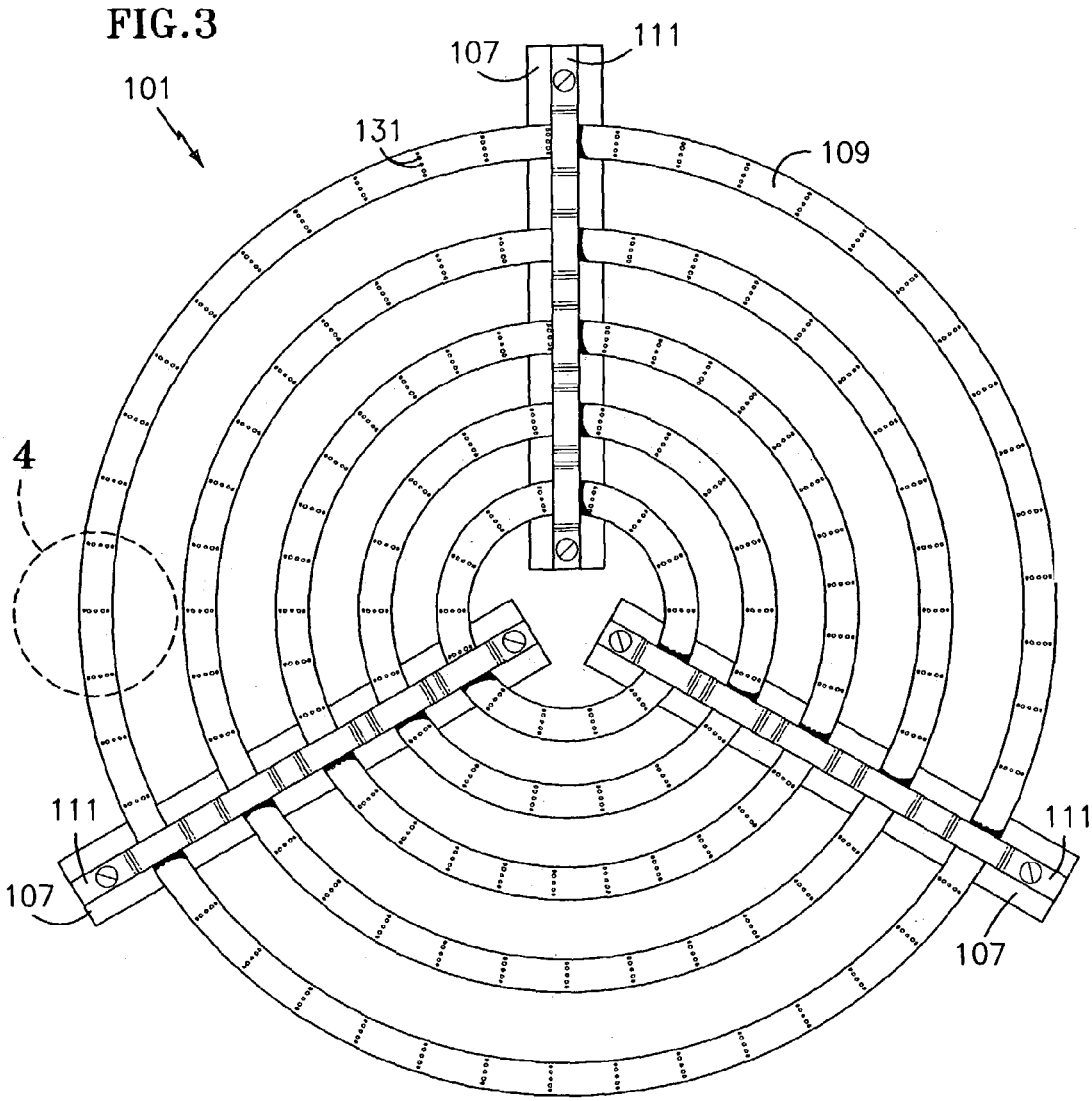
FIG. 3 is a plan view of one component of the quenching apparatus shown in FIG. 1.

FIG. 3 displays the first cooling section 101. The first cooling section 101 preferably corresponds to a bottom of the forging F. The first cooling section 101 includes one or more supports 107 arranged around the apparatus 100. Although the figure displays three, the present invention could use any suitable number of supports 107.

The supports 107 have recesses in which a plurality of concentric pipes 109 can reside. Although the figures show five, the present invention could utilize any number of pipes 109. The number of pipes 109 depends upon the geometry of the forging F. A larger forging F requires more pipes 109.

A plurality of spacers 111 secure to the supports 107 with conventional fasteners. The spacers 111 serve to retain the pipes 109 to the supports 107. Although the figures show each spacer 111 retaining multiple pipes 109, the spacer 111 could retain only one pipe. This would allow the individual adjustment of pipes 109 without disturbing the other pipes 109. Another important function of the spacers will be discussed below.

Figure 2:
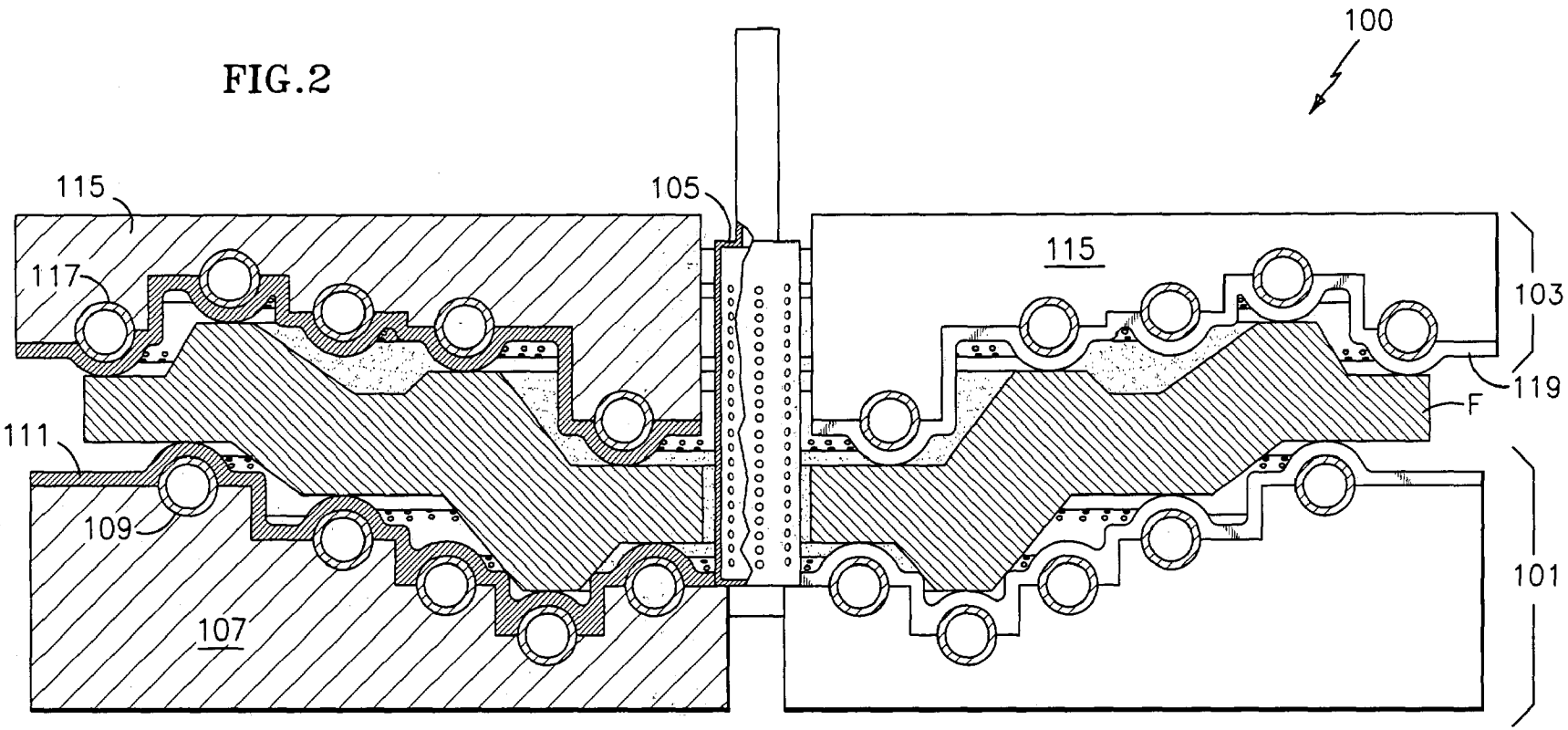
FIG. 2 is a cross-sectional view of the quenching apparatus taken along line II—II in FIG. 1.

As seen in FIG. 2, the top of the forging F could have a different shape than the bottom of the forging F. Accordingly, the second cooling section 103 may not mirror the shape of the first cooling section 101. Rather, the second cooling section 103 preferably conforms to the top of the forging F.

Similar to the first cooling section 101, the second cooling section 103 includes one or more supports 115, concentric pipes 117 and spacers 119. When fastened to the supports 115, the spacers 119 secure the pipes 117 to the supports 115. The supports 107, 115 and the spacers 111, 119 could be made from any material suitable to the demands of the quenching process.

For versatility, the apparatus 100 should accommodates forgings F of various shapes. For every forging F, the cooling sections 101, 103 should generally conform to the specific shape. This could be accomplished with conventional techniques. For example, the apparatus could utilize supports 107, 115 specific to each forging shape.

Alternatively, the same supports 107, 115 could be used for every forging F. To accommodate different shapes, the universal supports should include features (not shown) to allow selective positioning of each of the pipes 109, 117. In one possible arrangement, the universal supports could have height adjustable platforms upon which the pipes 109, 117 rest. The platforms could use a threaded shaft to adjust height.

In addition, either of the supports 107, 115 could be sized and shaped to allow an outermost pipe 109, 117 to surround the outer diameter of the forging F. This arrangement allows the apparatus 100 to quench the outer diameter of the forging F. Not all forgings F, however, require quenching at the outer diameter. As an example, forgings F with thin sections at the outer diameter typically do not require quenching.

Figure 4:
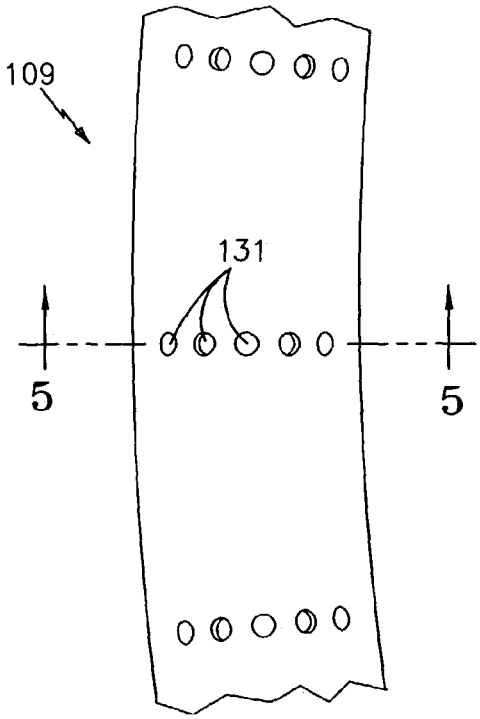
FIG. 4 is a detailed view of a portion of the component shown in FIG. 3.
Figure 5:
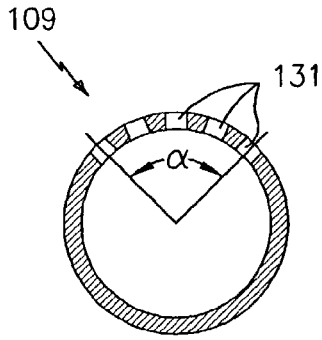
FIG. 5 is a cross-sectional view of the component taken along line V—V in FIG. 4.

FIGS. 4 and 5 display one of the pipes 109. The pipe 109 is annular to provide axisymmetric cooling to the annular forging F. The tubes 113 can be made from any suitable material, such as tooling steel (e.g. AMS5042, AMS5062, AISI4340), stainless steel (AISI310, AISI316, 17-4HP), copper and brass. As an example, the pipes 109 could have an inner diameter of between approximately 0.7" and 1.3" and have a suitable thickness. The specific values will depend upon the demands of the quenching process.

The pipes 109, 117 each have an inlet (not shown) attached to a fluid source 127 using conventional techniques. The source 127 could use conventional valves (not shown) to control fluid flow to each pipe 109, 117. The valves could either be manually or computer-controlled. The benefits of having such control will become clear below.

The pipes 109, 117 have an arrangement of openings 131 therein. Preferably, the openings are regularly arranged around the pipes 109, 117 to provide axisymmetric cooling to the forging F. However, non-symmetric arrangements are possible. As seen in FIG. 5, The openings 131 span an angle $\alpha$ of between approximately 25° and 270° of the circumference of the pipe 109, 117. Preferably, the angle $\alpha$ is approximately 90°.

The openings 131 in the pipes 109, 117 define outlet nozzles for the fluid to exit the cooling sections 101, 103. The fluid propels from the openings 131 to cool the forging F. The openings 131 could have either sharp edges or smooth edges in order to provide a desired nozzle configuration. Specific geometric aspects of the openings 131 will be discussed in detail below.

Figure 6:
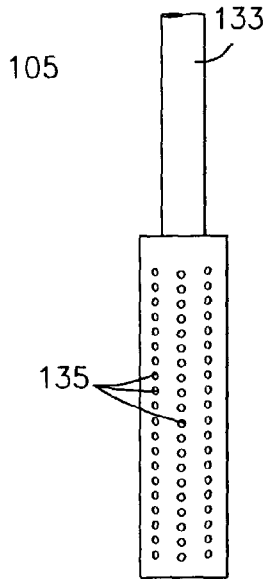
FIG. 6 is an elevational view of a second component of the quenching apparatus shown in FIG. 1.

FIG. 6 displays the central cooling section 105. The central cooling section 105 preferably resides within the inner bore of the forging F. As with the outer diameter, the inner diameter of the forging F may not require quenching. Forgings F with thin sections at the inner diameter typically do not require quenching.

Similar to the pipes 109, 117, the central cooling section 105 is a pipe that includes an inlet 133 attached to the fluid source 127 using conventional techniques. The central cooling section 105 also includes a plurality of openings 135 at an outlet end. The size and shape of the central cooling section 105 depends upon the geometry of the forging F.

Assembly of the apparatus 100 proceeds as follows. The assembled first cooling section 101 receives the forging F. Specifically, the forging F rests on the spacers 111. Then, the second cooling section 103 is placed over the forging F. Likewise, the spacers 111 rest on the forging F. Next, the central cooling section 105 is placed inside the central bore of the annular forging F. The central cooling section 105 preferably rests on the supports 107 of the first cooling section 101, and is spaced from the forging F by abutting the distal ends of the spacers 111. Other arrangements, however, are possible. The apparatus 100 is now ready to begin the quenching operation.

The apparatus could utilize any suitable fluid, such as a gas, to quench the forging F. Preferably, the present invention uses air. The source 127 could have a diameter of between approximately 2.5" and 3.5". The source 127 could also supply approximately 12 lb/sec of ambient (e.g. 65–95° F.) air to the apparatus 100 at a pressure of between approximately 45 and 75 psig. Again, the specific values will depend upon the demands of the quenching process.

Generally speaking, one goal of the present invention is to control the cooling rate of the forging F precisely. This precise control allows the use of impingement cooling on the forging F. Impingement cooling is a subset of forced convection cooling that produces significantly higher heat transfer coefficients than the remainder of the forced convection regime. For example, conventional forced air convection can achieve heat transfer coefficients of approximately 50 BTU/hr $ft^{2\circ}$ F. with typical equipment. Impingement cooling, on the other hand, can achieve heat transfer coefficients up to approximately 300 BTU/hr $ft^{2\circ}$ F.

Figure 7:
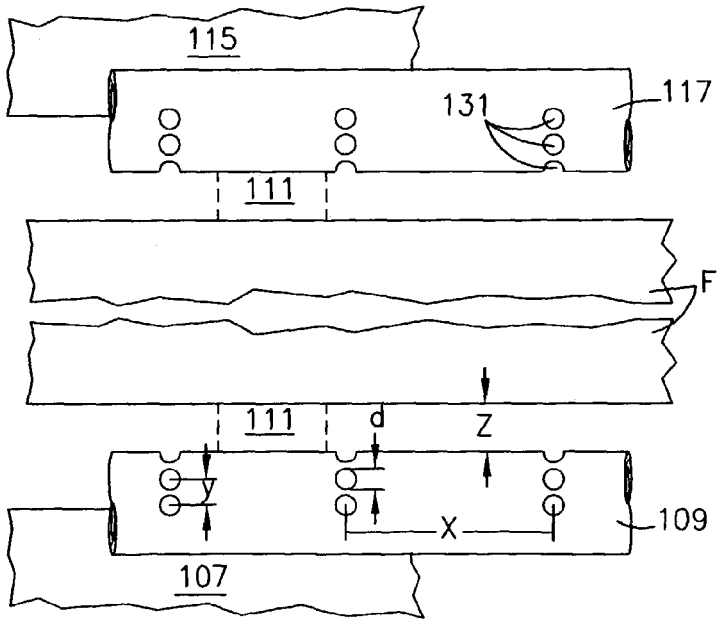
FIG. 7 is an elevational view of a section of the quenching apparatus shown in FIG. 1 with a forging placed therein.

FIG. 7 provides the spatial relationship between the pipes 109, 117 and the forging F. Although displaying the first and second cooling sections 101, 103, the spatial relationships shown in this figure are also applicable to the central cooling section 105. As seen in the figure, the spacers 111 provide a gap between the forging F and the pipes 109, 117.

The openings 131 in the pipe preferably have a diameter d adequate to propel a sufficient amount of fluid against the forging F to perform the quenching process. As an example, the diameter d of the openings 131 could be between approximately 0.55" and 0.75". At this diameter d, preferably between approximately 0.002 lb/sec and 0.01 lb/sec of fluid flows through each opening 131 at a velocity of between approximately 200 ft/sec and 1000 ft/sec.

The gaps formed between the pipes 109, 117 and the forging F created by the spacers 111 are an essential aspect of the present invention. The spacers 111 define a distance Z between the pipes 109, 117 and the forging F. The distance to diameter ratio (Z/d) should range between approximately 1.0 and 6.0.

A circumferential spacing X exists between adjacent openings 131 in the pipes 109, 117. The circumferential spacing of the openings 131 ensures adequate fluid flow to the forging F to achieve the desired cooling rate. The circumferential arrangement of the openings 131 also ensures axisymmetric cooling of the forging F. The circumferential spacing to diameter ratio (X/d) should be between approximately 0.0 and 24.0.

Finally, a radial spacing Y exists between adjacent openings 131 in the pipes 109. Similarly, the radial spacing of the openings 131 ensures adequate fluid flow to the forging F to achieve the desired cooling rate. The radial spacing to diameter ratio (Y/d) should be between approximately 0.0 and 26.0.

Using these parameters, the present invention can treat all sections of the forging using impingement cooling. Impingement cooling is preferred because of the combined effect of increased turbulence and increased jet arrival velocity significantly increases the heat transfer coefficient of the apparatus 100.

By varying the aforementioned parameters within the suitable ranges, the present invention can achieve another goal of the present invention—to reduce any differential between the cooling rates of different areas of the forging F. Ideally, the present invention seeks equalize the cooling rates across all areas of the forging.

The present invention reduces temperature gradients within the forging F by providing more impingement cooling to one area of the forging F compared to another area of the forging F. In terms of heat transfer, the volume of an object equates to thermal mass and the surface area of the object equates to cooling capacity. Objects exhibiting a low surface area to volume ratio cannot transfer heat as readily as objects with higher surface area to volume ratios.

The present invention seeks to increase the heat transfer of areas of the forging F that exhibit low surface area to volume ratios. Practically speaking, the present invention provides more cooling to surfaces of the forging F located adjacent larger volumetric sections than surfaces of the forging F located adjacent smaller volumetric sections.

The present invention can locally adjust impingement cooling by varying any of the aforementioned characteristics. For example, one can selectively adjust cooling to desired areas of the forging F by adjusting the diameters of the pipes 109, 117, by adjusting the diameter of the openings 131, by adjusting the size of the spacer 111 or by adjusting the density of the openings 131 (i.e. adjust spacing distances X or Y) during the system design stage. During operation of the apparatus 100, one can selectively adjust the cooling to desired areas of the forging F by adjusting pressure in each pipe 109, 117, 105. The aforementioned valves on the supply 127 could be used to adjust pressure. Any other technique to adjust pressure could also be used.

The present invention could leave these characteristics static during the quenching process. In other words, the apparatus 100 could keep the selected pressures in the pipes 109, 117, 105 constant throughout the entire temperature range of the quenching process. Alternatively, the present invention could dynamically adjust the pressures in the pipes 109, 111, 105 during the quenching process. For example, the apparatus 100 could operate at a desired pressure until the course grain nickel alloy forging F exits the temperature range of the ductility trough (e.g. 1800–2100° F.). Thereafter, the apparatus could operate at a reduced pressure for the remainder of the quenching process. Other variations are also possible.

The present invention can produce heat transfer coefficients greater than those created by oil bath quenching (e.g. 70–140 BTU/hr $ft^{2}$° F.) or fan quenching (e.g. 50 BTU/hr $ft^{2}$° F.). The present invention can produce a heat transfer coefficient of approximately 300 BTU/hr $ft^{2}$° F.

Despite the higher heat transfer coefficient, the quenched products that the present invention produces exhibit lower residual stress values than those products created by oil bath quenching. The arbitrary cooling rate of oil bath quenching produces high residual stress values. The present invention, on the other hand, achieves lower residual stress values because of the ability to differentially cool the forging F (i.e. control the temperature gradients across the forging). Note that reference to the residual stress values produced by fan quenching is not appropriate because fan quenching cannot meet the cooling requirements needed to quench high temperature aerospace alloys.

It may be desirable to enhance the cooling beyond that provided by a relatively dry cooling gas (e.g., air). This may include adding additional fluid to the gas. Exemplary additional fluid is water introduced as a mist or introduced as steam. Although the steam may be relatively hot compared with ambient temperature, it may be relatively cool compared with the forging.

Figure 8:
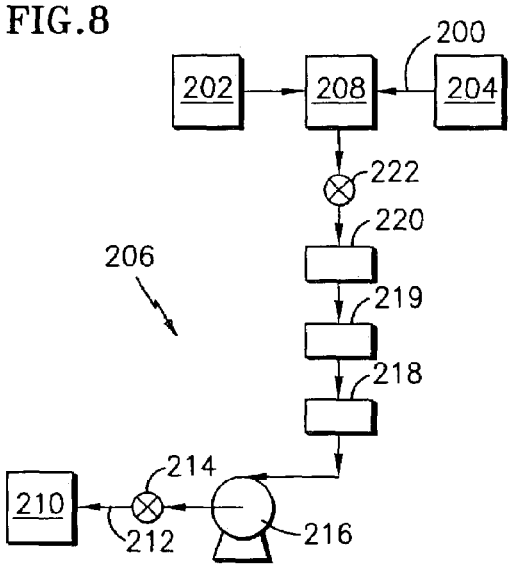
FIG. 8 is a schematic view of a system for adding mist to cooling air.
Figure 9:
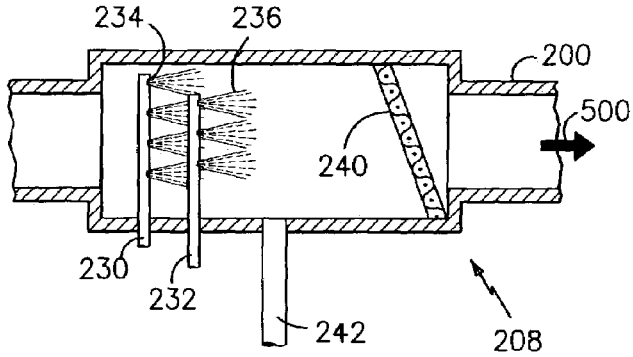
FIG. 9 is a view of an atomizer of the system of FIG. 8.

FIG. 8 shows an air conduit 200 extending from an air source 202 to a quenching apparatus 204 which may be otherwise similar to the apparatus 100. A mist generation system 206 is provided and has an atomizer or mist injection assembly 208 in-line in the conduit 200. From upstream-to-downstream, the mist generation system includes a water source 210 coupled to the atomizer assembly 208 by a conduit system 212. In-line in the conduit system 212 are a control valve 214, a high pressure pump 216, multiple stages of filters 218 and 219, a flow meter 220, and a safety valve 222. FIG. 9 shows further details of the atomizer assembly 208. A plurality of distal branches 230, 232 of the conduit system 212 have outlet apertures 234 expelling atomized mist sprays 236 in a downstream direction 500. A filter 240 downstream of the outlet apertures prevents passage of droplets greater than a given size. Water stopped by the filter 240 as well as other water which is not entrained in the air flow through the atomizer drains to a drain conduit 242 and may be returned to the source 210 or otherwise reintroduced into the misting circuit.

An exemplary flow rate of the mist is between five and twenty percent (inclusive unless otherwise noted) of the air flow rate (thus between about five and seventeen percent of the mixture). An exemplary characteristic droplet size (e.g., mean/median/mode) is between ten micrometers and five hundred micrometers. For generating the mist, exemplary pump pressures are on the order of approximately 1,000 psi.

Figure 10:
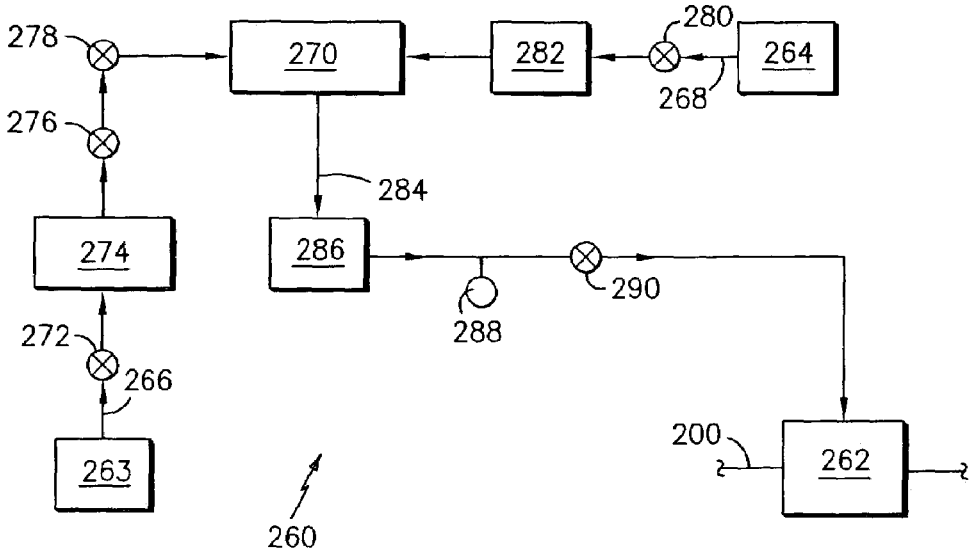
FIG. 10 is a schematic view of a system for injecting steam into cooling air.

FIG. 10 shows a steam generation system 260 having a steam injector 262 positioned in the air conduit 200 in lieu of the mist system 206 and atomizer 208. The exemplary system 260 involves cooling superheated steam from a steam source 263 with cooling water from a water source 264 which may respectively be house steam and water in the industrial setting. Conduits 266 and 268 from these sources respectively lead to a desuperheater 270. In-line in the first conduit 266 are a control valve 272, a strainer 274, a pressure regulator 276, and a relief valve 278. In-line in the second conduit 268 are a control valve 280 and a water filter 282. In the desuperheater, the superheated steam is mixed at an appropriate ratio with water to form working steam which is discharged along a conduit 284 toward the injector 262. In-line in the conduit 284 are a steam filter 286, a pressure gauge 288, and a safety valve 290. Various commercial products may incorporate multiple of these components. For example, products are available from Mee Industries, Inc., Monrovia, Calif. and Atomizing Systems, Inc., Ho-Ho-Kus, N.J. In exemplary embodiments, the superheated steam is at a temperature in excess of 368° F. and a pressure in excess of 150 psi whereas the working steam is at a temperature of approximately 240° F. and a pressure of between 1.5 and 80 psi. In exemplary embodiments, the working steam forms at least 20% of the volumetric flow rate of the air-steam mixture. Possibilities are comprehended of there being substantially no air and mere steam introduced.

Figure 11:
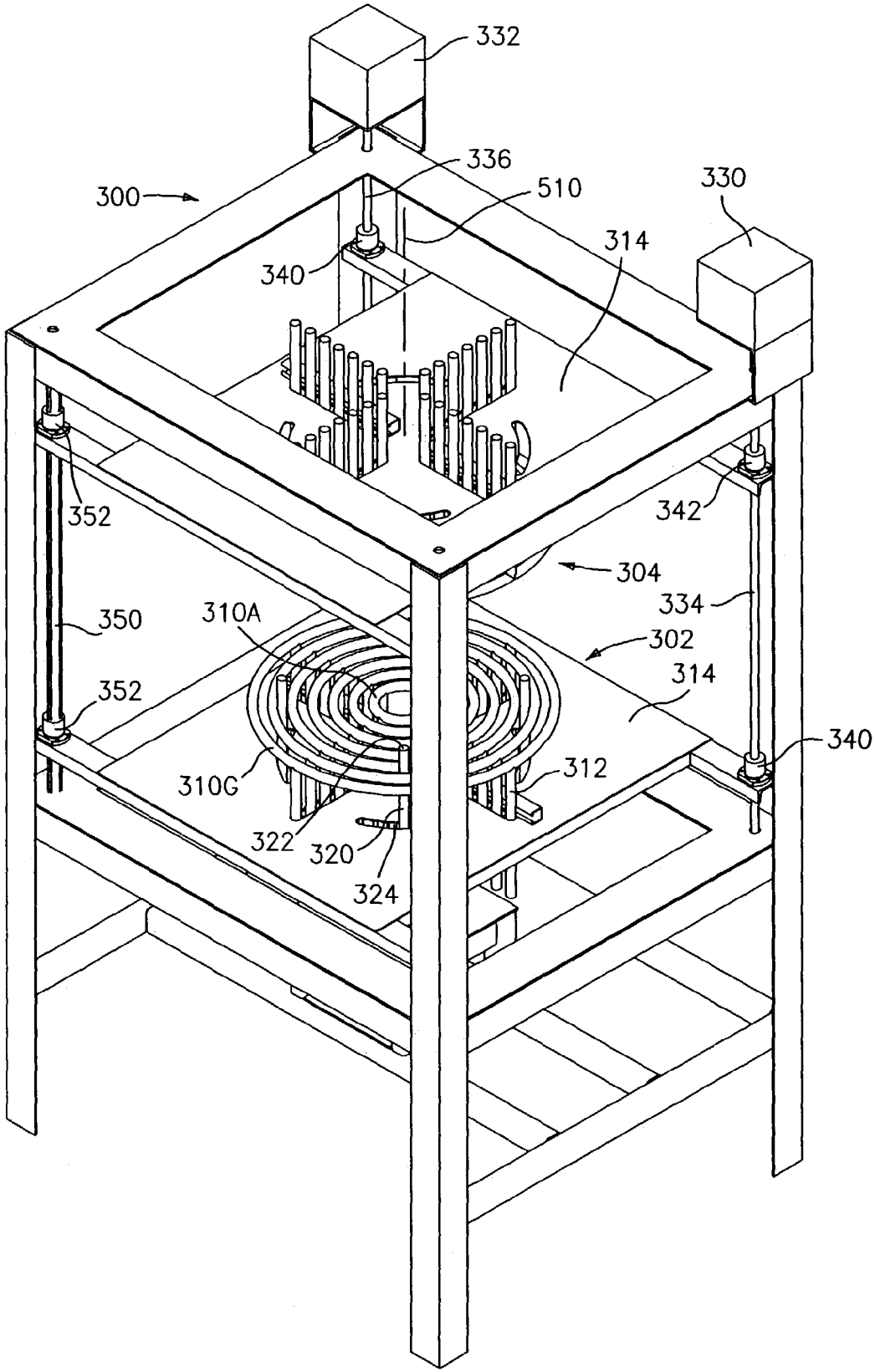
FIG. 11 is a view of an alternate embodiment of the quenching apparatus.

FIG. 11 shows an alternate quench apparatus 300 having first (lower) and second (upper) cooling sections 302 and 304, respectively. Each of the cooling sections comprises a number of outlet conduits or pipes concentric about a central axis 510 from an innermost pipe 310A to an outermost pipe 310G. These outlet pipes may be similarly formed to the pipes 109, 117 of FIG. 1. Each of the outlet pipes 310A–310G has an exemplary four feeder conduits 312 extending away from the transverse (horizontal) centerplane of the apparatus. The exemplary conduits 312 are spaced at 90° intervals about the axis 510 and extend through and are repositionably secured to a support plate 314 such as by means of clamps (not shown). The feeder conduits are coupled by appropriate branching conduits to the aforementioned air conduit 200 downstream of the atomizer or steam injector. The clamps permit the outlet pipes of the first and second sections to be vertically staggered to correspond to the surface contours of first and second surfaces of the forging (e.g., as in the stagger of FIG. 2). The clamps permit the pipes to be repositioned to accommodate different forgings of different first and second surface profiles. Forgings of different diameters may be accommodated and, when forgings of diameters substantially smaller than the diameter(s) of the outermost pipe(s) are processed, valves (not shown) may be used to shut off flow through such outermost pipe(s).

In yet a further variation, the forging may be supported other than on the first section. For example, FIG. 11 shows a plurality of support rods 320 having distal (upper) tip surfaces 322 and extending vertically through slots 324 in the support plate 314 of the first section 302. The forging may be supported atop these surfaces 322. One or both of the sections 302 and 304 may be vertically movable to position the associated outlet pipes in an operative position proximate the associated surface of the forging. In the exemplary embodiment, both sections are movable toward and away from the transverse centerplane. For example, first and second motors 330 and 332 may be coupled to the respective sections by drive screws 334 and 336 so that driven rotation of the screws about their axes in forward and reverse directions brings the sections toward and away from the transverse centerplane. In the exemplary embodiment, each of the sections has a follower nut 340 engaging the associated drive screw and a bushing 342 passing the drive screw of the other section. A pair of additional smooth guide rods 350 may be provided with each section having an associated bushing 352 freely passing such guide rod. Advantageously the positions of the outlet pipes are such that, when the sections are brought together to their operative position proximate the forging, the forging remains supported by the surfaces 322.

Figure 12:
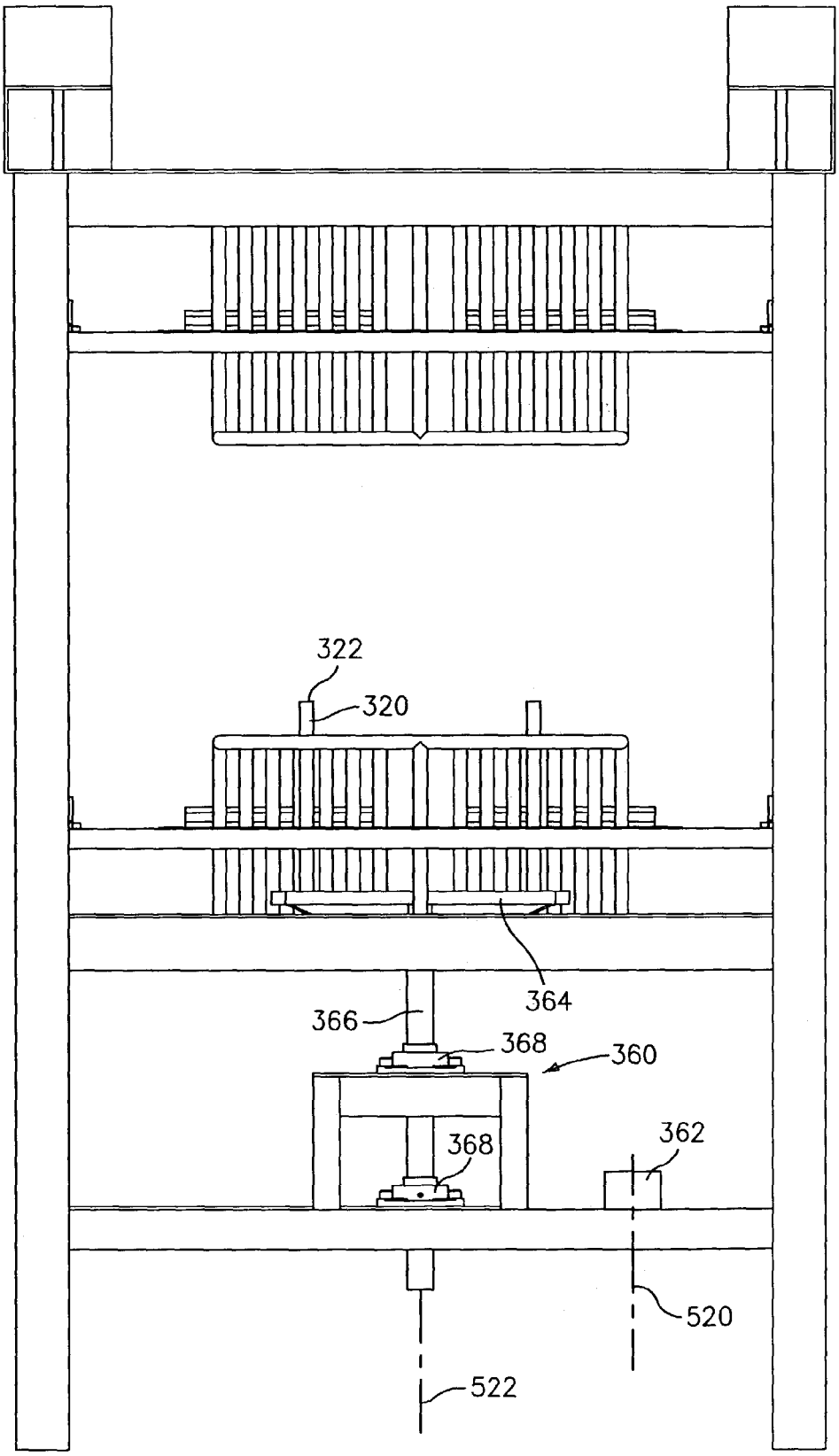
FIG. 12 is a side view of the apparatus of FIG. 11.
Figure 13:
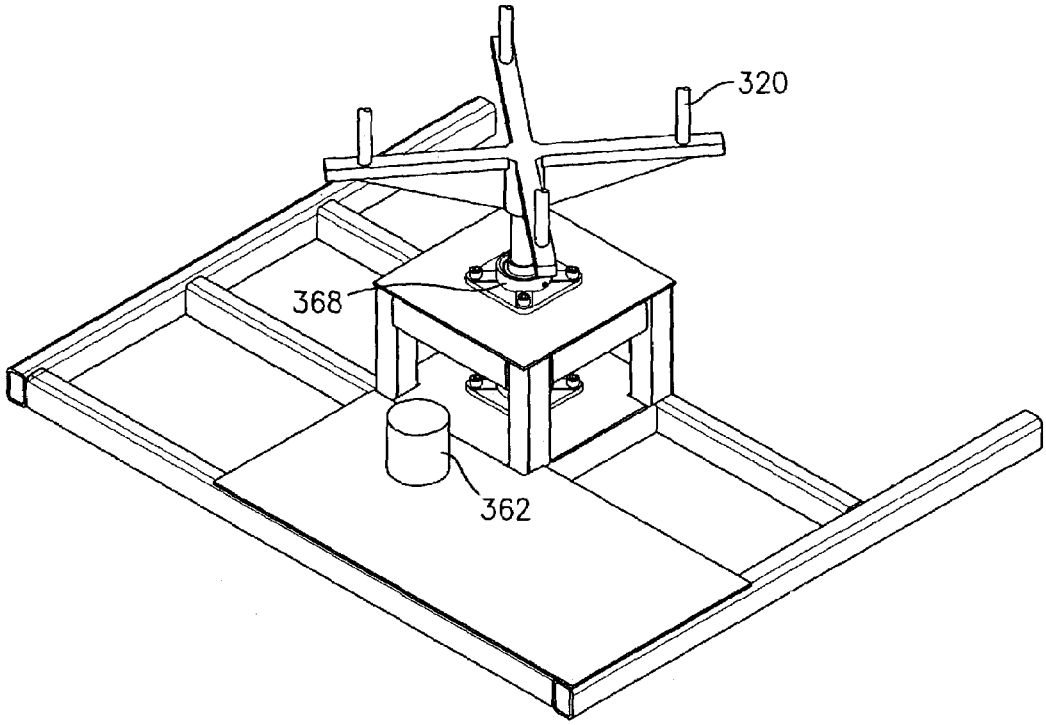
FIG. 13 is a view of an oscillation actuator of the apparatus of FIG. 11.
Figure 14:
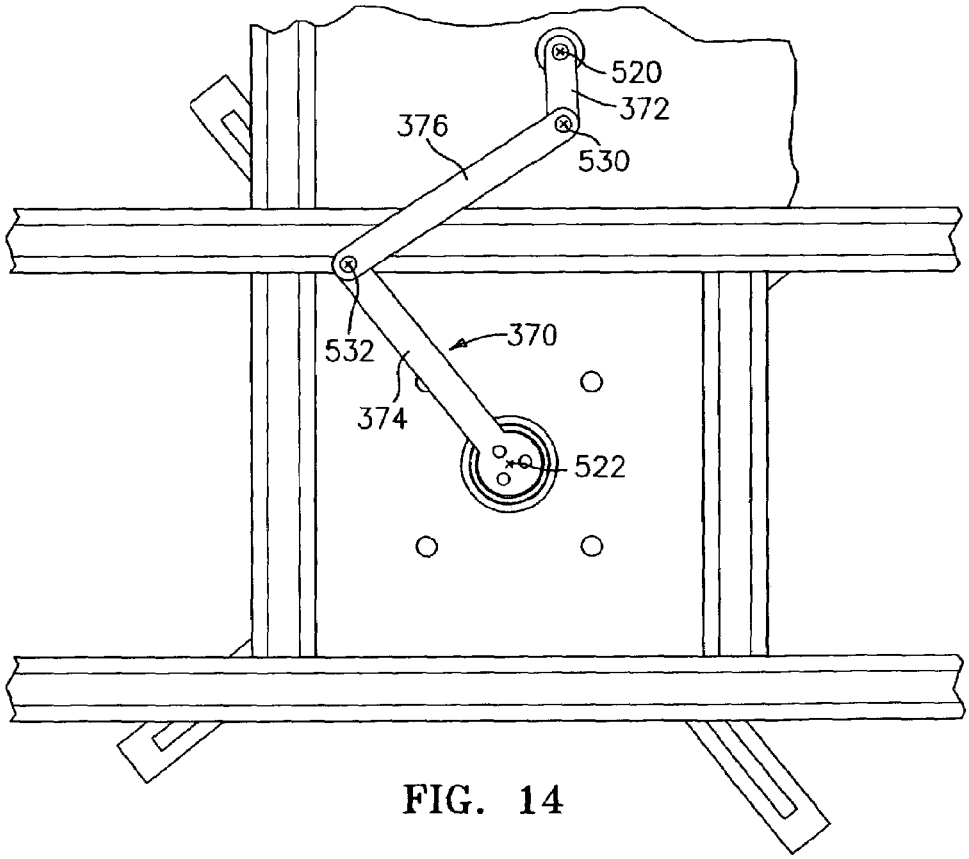
FIG. 14 is a bottom view of a linkage of the actuator of FIG. 13.

Additionally, means may be provided for moving the forging relative to the impinging streams during the quench. The movement of the forging relative to the impinging streams from the outlet apertures of the outlet pipes further distributes the cooling effect to reduce the local thermal gradients caused by the impinging jets on the surface of the forging. The exemplary movement may be continuous or may be oscillatory. In an exemplary embodiment, the movement involves absolute movement of the forging with the conduit system outlet apertures remaining fixed. FIG. 12 shows an exemplary oscillatory movement actuator 360. The actuator includes a motor 362 having a rotor/shaft axis 520. The rods 320 are supported at associated ends of a cruciform support structure 364. The structure 364 is mounted to the upper end of an actuator shaft 366 supported for rotation about it central axis 522 by a pair of bearings 368 (also FIG. 13). The motor 362 is coupled to the shaft 366 by means of a linkage 370 (FIG. 14) having: a first link 372 fixed relative to the motor shaft; a second link 374 fixed relative to the actuator shaft; and a third link 376 joining the first two links at pivotal joints having respective axes of rotation 530 and 532. In the exemplary embodiment, continuous rotation of the motor shaft about its axis produces reciprocal rotation of the actuator shaft about its axis through a given angular range. An exemplary range is a +22.5° to −22.5° cycle per 360° cycle of the motor. Much smaller cycles are possible as are larger cycles and continuous rotation. The exemplary 45° oscillation is a relatively slow component for moving the forging relative to the impinging streams. An exemplary rate of such oscillation is 0.33 Hz.

One or more embodiments of the present invention have been described. Nevertheless, it will be understood that various modifications may be made without departing from the spirit and scope of the invention. For example, details of the particular forging may influence details of any associated implementation. Accordingly, other embodiments are within the scope of the following claims.

What is claimed is:

1. An apparatus cooling a metallic workpiece, the apparatus comprising:

a support surface for supporting the workpiece in an operative position;

a source of a cooling gas and an additional coolant, said cooling gas comprising one or more constituent gases that are gases at ambient conditions and said additional coolant comprising one or more constituents that are liquid at ambient conditions; and a conduit system directing the cooling gas and additional coolant from the source and having a plurality of outlets positioned to discharge a mixture of the cooling gas and the additional coolant to impinge the workpiece in the operative position;

a motor; and a linkage coupling the motor to at least one of the support surface conduit system and driven by the motor to produce oscillation of the workpiece relative to the outlets.

2. The apparatus of claim 1 wherein:

the source comprises a first source of the cooling gas and a second source of the additional coolant.

3. The apparatus of claim 1 wherein:

the source comprises a first source of the cooling gas and a second source being a source of water; and said water in said mixture has a mass flow rate of 5–20% of a mass flow rate of said cooling gas.

4. The apparatus of claim 3 wherein:

a major portion of said water in said mixture is steam.

5. The apparatus of claim 3 wherein:

a major portion of said water in said mixture is in droplet form.

6. The apparatus of claim 1 wherein:

a said support surface is provided by surface portions of a plurality of vertically-extending rods.

7. An apparatus for cooling a metallic workpiece, said workpiece having a cross-section including a first portion that is substantially thicker and more massive than a second portion that is relatively thinner and less massive, said apparatus comprising:

a fixture for supporting the workpiece;

a source of a mixture of a compressed cooling gas containing liquid droplets for quenching the work piece;

a set of tubes for delivering and directing the compressed cooling gas onto said workpiece for cooling, so that said compressed cooling gas flows onto said first portion that is substantially thicker and more massive and away from said second portion that is relatively thinner and less massive; and means for providing relative movement of the workpiece and tubes during the cooling.

8. The apparatus of claim 7 wherein the source includes:

at least a first gas source of said cooling gas; and means for adding said liquid droplets to the cooling gas along a gas flowpath between the first gas source and the workpiece.

9. An apparatus for cooling a heat-treated metallic workpiece, said apparatus comprising:

a fixture for supporting the workpiece;

a source of a cooling gas for quenching the workpiece;

a conduit system delivering the cooling gas from the source and directing the cooling gas onto the workpiece so as to cool the workpiece; and means for moving the workpiece relative to the conduit system during the cooling of the workpiece.

10. The apparatus of claim 9 wherein the means for moving produces oscillation of the workpiece relative to the conduit system.

11. The apparatus of claim 9 wherein the means for moving comprises:

an electric motor; and a mechanical linkage coupling the motor to the fixture so that continuous rotation of shaft of the motor in a first direction produces oscillation of the fixture.

12. The apparatus of claim 9 wherein the means for moving comprises:

an electric motor; and a mechanical linkage coupling the motor to the fixture so that rotation of the motor drives a rotary oscillation of the workpiece.

13. The apparatus of claim 10 further comprising at least one motor coupled to the conduit system to bring the conduit system into an operation position relative to the workpiece.

14. The apparatus of claim 9 further comprising at least one motor coupled to the conduit system to bring the conduit system into an operative position relative to the workpiece.

15. The apparatus of claim 1 wherein the motor is a first motor and one or more second motors are coupled to the conduit system by lead screws to bring the outlets into an operative position relative to the workpiece.

16. An apparatus for cooling a heat-treated metallic workpiece, said apparatus comprising:

a fixture for supporting the workpiece;

a source for cooling gas for quenching the workpiece;

a conduit system delivering the cooling gas from the source and directing the cooling gas onto the workpiece so as to cool the workpiece; and first means for positioning a first plurality of outlets of the conduit system relative to a second plurality of outlets of the conduit system the first and second pluralities of outlets being essentially on opposite sides of the workpiece; and second means for moving the workpiece relative to the conduit system during the cooling of the workpiece.

17. The apparatus of claim 16 wherein the first means comprises at least one motor coupled to at least one lead screw.

18. The apparatus of claim 17 wherein the second means comprises at least one additional motor and a linkage coupling the additional motor to produce rotary oscillation of the workpiece relative to at least on of the first and second pluralities of outlets.

19. An apparatus cooling a metallic workpiece, the apparatus comprising:

a support surface for supporting the workpiece in an operative position;

a source of cooling gas and an additional coolant, said cooling gas;

a conduit system directing the cooling gas and additional coolant from the source and having a plurality of outlets positioned to discharge the cooling gas to impinge the workpiece in the operative position;

a motor; and a linkage coupling the motor to at least one of the support surface the conduit system and driven by the motor to produce oscillation of the workpiece relative to the outlets.

20. The apparatus of claim 19 wherein the linkage couples the motor to the support surface.

21. The apparatus of claim 20 further comprising at least one additional motor coupled to the conduit system to bring the outlets into an operative position relative to the workpiece.

22. The apparatus of claim 20 wherein the support surface comprises distal tip surfaces of a plurality of support rods.

23. The apparatus of claim 19 wherein the support surface comprises distal tip surfaces of a plurality of support rods.

24. The apparatus of claim 19 further comprising at least one additional motor coupled to the conduit system to bring the outlets into an operative position relative to the workpiece.

* * * * *

UNITED STATES PATENT AND TRADEMARK OFFICE

CERTIFICATE OF CORRECTION

PATENT NO. : 7,182,909 B2
APPLICATION NO. : 10/621298
DATED : February 27, 2007
INVENTOR(S) : Albert Rabinovich It is certified that error appears in the above-identified patent and that said Letters Patent is hereby corrected as shown below:

In column 9, claim 1, line 51, after “conditions;” delete “and”.

In column 10, claim 13, line 58, “claim 10” should read --claim 12--.

In column 10, claim 13, line 60, “operation” should read --operative--.

In column 11, claim 16, line 4, after “source” delete “for” and insert --of a--.

In column 11, claim 18, line 21, after “least” delete “on” and insert --one--.

In column 11, claim 19, line 27, after “source of” insert --a--.

Signed and Sealed this

Eighteenth Day of December, 2007

JON W. DUDAS
*Director of the United States Patent and Trademark Office*